US011236592B2

(12) United States Patent
Josefsen

(10) Patent No.: US 11,236,592 B2
(45) Date of Patent: Feb. 1, 2022

(54) VALVE SYSTEM

(71) Applicant: PETROLEUM TECHNOLOGY COMPANY AS, Stavanger (NO)

(72) Inventor: Kristian Korbøl Josefsen, Stavanger (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 108 days.

(21) Appl. No.: 16/625,982

(22) PCT Filed: Jun. 26, 2018

(86) PCT No.: PCT/NO2018/050168

§ 371 (c)(1),
(2) Date: Dec. 23, 2019

(87) PCT Pub. No.: WO2019/004838

PCT Pub. Date: Jan. 3, 2019

(65) Prior Publication Data

US 2020/0355050 A1 Nov. 12, 2020

(30) Foreign Application Priority Data

Jun. 27, 2017 (NO) ..... 20171051

(51) Int. Cl.
*E21B 43/12* (2006.01)
*E21B 33/12* (2006.01)
*E21B 34/10* (2006.01)

(52) U.S. Cl.
CPC ..... *E21B 43/123* (2013.01); *E21B 33/12* (2013.01); *E21B 34/105* (2013.01)

(58) Field of Classification Search
CPC ..... E21B 43/123; E21B 33/12; E21B 34/105; E21B 34/107; E21B 23/03; E21B 34/06
See application file for complete search history.

(56) References Cited

U.S. PATENT DOCUMENTS 5,042,584 A 8/1991 Terral
6,082,455 A * 7/2000 Pringle ..... E21B 43/12 166/250.15

(Continued)

FOREIGN PATENT DOCUMENTS

GB 2506512 A 4/2014
WO 0000717 A1 1/2000
WO 2016071200 A1 5/2016

OTHER PUBLICATIONS

PCT International Search Report; PCT/NO2018/050168; dated Nov. 28, 2018.

(Continued)

*Primary Examiner* — Steven A MacDonald
(74) *Attorney, Agent, or Firm* — Bracewell LLP; Constance G. Rhebergen; Linda L. Morgan

(57) ABSTRACT

A valve system for use in a wellbore, comprising a side pocket mandrel having a main bore for alignment with a wellbore tubular and a laterally offset side pocket bore separated from the main bore by an internal wall, the laterally offset side pocket bore comprising a first receptacle for a first device and a second receptacle for a second device, the internal wall having an opening through which each of the first device and the second device is independently retrievable. There is also provided a side pocket mandrel, a hydrocarbon well and a method of operating a hydrocarbon well.

29 Claims, 3 Drawing Sheets

(56) References Cited

U.S. PATENT DOCUMENTS

| | | | | |
|---|---|---|---|---|
| 6,422,312 | B1 * | 7/2002 | Delatorre | E21B 43/12 166/250.15 |
| 7,228,909 | B2 | 6/2007 | Schmidt et al. | |
| 9,140,096 | B2 * | 9/2015 | Tveiten | E21B 34/106 |
| 9,587,463 | B2 * | 3/2017 | Tveiten | E21B 43/123 |
| 2010/0084139 | A1 | 4/2010 | Moreno | |
| 2011/0315401 | A1 * | 12/2011 | White | E21B 43/123 166/385 |
| 2012/0292034 | A1 | 11/2012 | Fay | |
| 2012/0305256 | A1 * | 12/2012 | Tveiten | E21B 34/106 166/319 |
| 2014/0290962 | A1 * | 10/2014 | Tveiten | E21B 34/106 166/373 |

OTHER PUBLICATIONS

Norwegian Search Report; NO 20171051; dated Feb. 1, 2018.
Australia Examination Report No. 2 dated Mar. 11, 2021, pp. 1-7.

* cited by examiner

VALVE SYSTEM

BACKGROUND

Field of the Disclosure

The present disclosure relates to a valve system suitable for use in various types of downhole operations in petroleum wells.

Description of the Related Art

An oil and/or gas well is drilled into a hydrocarbon bearing earth formation, where the well is typically completed in order to allow hydrocarbon production from the formation. Such a formation may be comprised of several different layers, where each layer may contain one or more hydrocarbon components. Often, such a formation will also contain water, gas, etc. Due to this, the conditions of production, i.e. the amount of oil, gas, water and pressure in the formation, will generally vary through the different layers of the formation, and will also vary during the production lifetime of the well. This may require intervention in the well and for this, suitable equipment is required, such as valve systems.

One such type of equipment is gas lift valves. Hydrocarbon production often begins with sufficient pressure in the formation to force the hydrocarbons to the surface. As the production from the well continues, the reservoir usually loses pressure until sufficient production of hydrocarbons from the well is no longer provided by the formation pressure. In some wells, the formation pressure is insufficient to support the production from the well, even when the well is first completed.

Due to this, so-called artificial lift is often used to supplement the formation pressure to lift the hydrocarbons from the formation to the surface of the well. The basic idea for all artificial lifting systems is to extract more hydrocarbons out of the reservoir. For instance, an oil and/or gas well may be arranged with a sucker rod lifting system, where such a system normally comprises a drive mechanism arranged on a surface of the well, a sucker rod string and one or more downhole positive displacement pumps. Hydrocarbons can then be brought up to the surface of the wellbore, by pumping action of the downhole' pump(s).

An alternative artificial lift system is a so-called gas lift system, where high pressure gas is injected into a production tubing of the well. In the gas lift system, the high pressure gas from the surface can for instance be supplied through a space (annulus) between the production tubing and a casing of the well. The gas enters the production tubing from the annulus side through one or more gas lift valves arranged along a length of the production tubing. The gas lift valve(s) may be positioned or arranged in the production tubing itself, or they may be arranged in so-called side pocket mandrels.

Other applications where downhole valve systems are required include chemical injection, i.e. systems for injecting chemicals into a well tubing and/or into the formation itself, and water injection valves, for example for waterflooding of reservoirs. Various other downhole operations may also require valve systems for which the present disclosure may be relevant.

Documents which can be useful for understanding the background include: US 2014/0290962 A1; US 2010/0084139 A1; U.S. Pat. No. 9,140,096 B2; U.S. Pat. No. 6,082,455; US 2011/0315401 A1; and U.S. Pat. No. 7,228,909 B2.

Common for such valve systems are generally that they need to be compact and operationally reliable. With the current trend in the industry to explore more unconventional resources, and the continuous need for improved technical solutions for downhole tools, there is a need for improved valve systems suitable for downhole use in oil and gas wells. The present disclosure has the objective to provide a valve system which provides advantages over known solutions and techniques.

SUMMARY

In an embodiment, there is provided a valve system for use in a wellbore, the valve system comprising a side pocket mandrel having a main bore for alignment with a tubular in the wellbore and a laterally offset side pocket bore, the main bore and the laterally offset side pocket bore being separated by an internal wall, the laterally offset side pocket bore comprising a first receptacle for a first device and a second receptacle for a second device, the internal wall having an opening through which each of the first device and the second device is independently retrievable.

In an embodiment, there is provided a side pocket mandrel comprising a longitudinally extending production conduit having a central longitudinal axis; a first pocket for accepting a barrier valve, the first pocket having a first central axis; a second pocket for accepting a barrier valve, the second pocket having a second central axis; a first passage fluidly connecting an outside of the side pocket mandrel to an inside of the first pocket; a second passage fluidly connecting the inside of the first pocket to an inside of the second pocket; a third passage fluidly connecting the inside of the second pocket to the production conduit; a fourth passage connecting the first and second pockets to the production conduit and allowing insertion of a barrier valve into the first and/or second pocket via the fourth passage.

In an embodiment, there is provided a hydrocarbon well having a production tubing extending from a wellhead into a subterranean formation, wherein the production tubing comprises at least one of a valve system or a side pocket mandrel.

In an embodiment, there is provided a method of operating a hydrocarbon well having a production tubing extending from a wellhead into a subterranean formation and comprising at least one of a valve system or a side pocket mandrel, the method comprising flowing gaseous a fluid into a well annulus, through the valve system or the side pocket mandrel, and up the production tubing.

Further embodiments are outlined in the detailed description below and in the appended claims.

BRIEF DESCRIPTION OF THE DRAWINGS

Illustrative embodiments of the present disclosure will now be described with reference to the appended drawings, in which.

DETAILED DESCRIPTION

Figure 1:
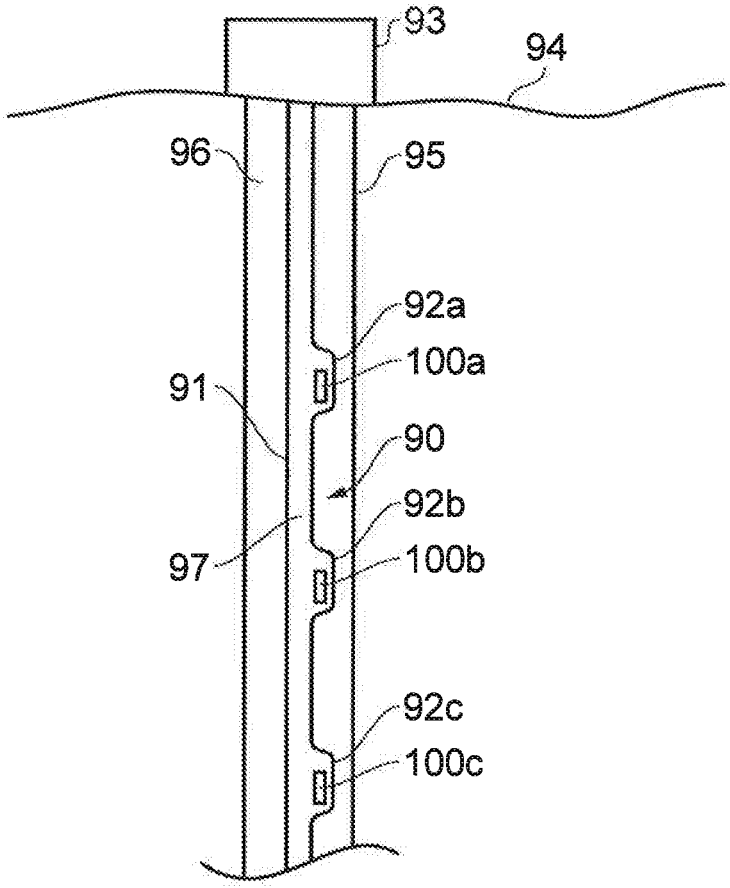
FIG. 1 shows a petroleum well arrangement.

FIG. 1 illustrates schematically a petroleum well arrangement according to an embodiment. A production tubing 90 extends from a wellhead 93 located on a land surface 94. The wellhead 93 may alternatively be located on a subsea surface, or a platform deck. A well casing 95 extends towards a subterranean reservoir (not shown). The production tubing 90 comprises a pipe 91 having at least one side pocket mandrel 92*a-c*. Each side pocket mandrel 92*a-c* has an opening which permits fluid communication between the inside 97 of the production tubing 90 and an annulus 96 between the well casing 95 and the production tubing 90. At least one tool, in this embodiment valves 100*a-c*, is arranged in each respective side pocket mandrel 92*a-c*.

FIGS. 2-6 illustrate a valve system 101 according to an embodiment, which can be used, for example, in the petroleum well arrangement illustrated in FIG. 1. The valve system comprises a side pocket mandrel 92. The side pocket mandrel 92 can be installed in the string 91 of the production tubing 90 in a well bore by means of end connectors 104 and 105. This allows production fluids to pass through the side pocket mandrel 92, and it allows access to the inside of the side pocket mandrel 92 through the inside of the production tubing 90. An inlet opening 106 (or, alternatively, several inlet openings) is provided on the outside surface of the side pocket mandrel 92. The functioning of the inlet opening 106 will be described in more detail below.

The side pocket mandrel 92 is provided with a main bore 102 (see FIG. 3) which (when installed) is aligned with the bore of the string 91 and with a laterally offset side pocket bore 103 which is designed to receive different downhole devices. Such downhole devices can be passed through the production tubing 90 and are retrievably seated in the offset side pocket bore 103 in order to perform a function, for example to control a fluid flow or to monitor operational parameters in the well bore. The downhole devices are retrievable and can be installed or recovered from the offset side pocket bore 103 for instance by means of a kick over tool or similar tools. The laterally offset side pocket bore 103 comprises a first receptacle 108 and a second receptacle 109 for the devices. Such downhole devices typically include flow control devices, gas-lift devices, chemical injection devices etc., for use in production operations. The side pocket mandrel 92 may also accommodate other equipment, for instance sensors, plugs, orifice or choke valves, bellows valves, nitrogen charged dome valves, pilot valves, differential valves, etc.

A first gas lift valve 200 and a second gas lift valve 201 are arranged in the first and second receptacles 108,109, respectively. Alternatively, other devices may be used in conjunction with the valve system 101, for example other types of flow control valves, chemical injection valves, one way valves, sensor units, dummy plugs, or other devices or equipment required downhole.

The main bore 102 and the laterally offset side pocket bore 103 are separated by an internal wall 107 having an opening 110 through which each of the first and second gas lift valves 200,201 (or a different device, if applicable) is independently retrievable. This can be done, for example, with a kick over tool which is passed down the tubing 90 to engage the valves 200,201 in the laterally offset side pocket 103.

The opening 110 is common for both receptacles 108,109, and both valves 200,201 (or other devices) may therefore be installed or retrieved through the same opening 110. The receptacles 108,109 are for this purpose arranged longitudinally spaced in opposite end sections 103*a*,103*c* of the laterally offset side pocket bore 103. Consequently, a kick over tool (or alternative tool for this purpose) can engage either valve 200,201, with one valve being installed in an uphole direction and one valve being installed in a downhole direction. The opening 110 is arranged between the end sections 103*a*,103*c*. As can be seen in most clearly in FIG. 6, the valves 200,201 may comprise a tool engagement element 203 configured for cooperating with such an installation or retrieval tool for retrieving the valves 200,201 through the opening 110.

The first receptacle 108 and the second receptacle 109 may be arranged co-axially, i.e. that their central axes 114 and 115 coincide, or they may be offset in relation to each other, for example with a small offset between the central axes 114 and 115 in the circumferential direction of the side pocket mandrel 92.

Figure 2:
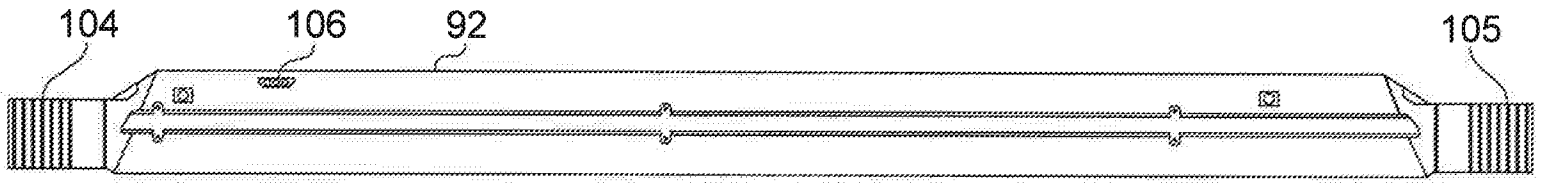
FIG. 2 shows a valve system according to an embodiment.
Figure 3:
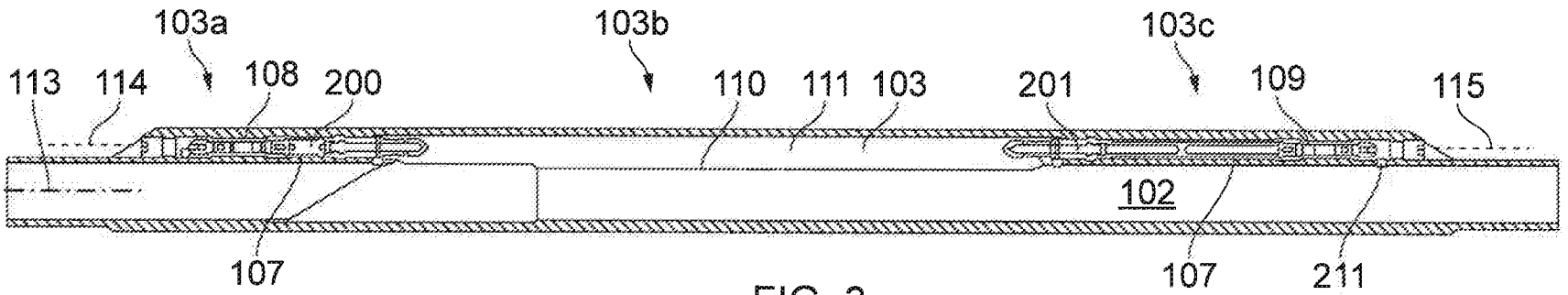
FIG. 3 shows details of the valve system shown in FIG. 2.
Figure 4:
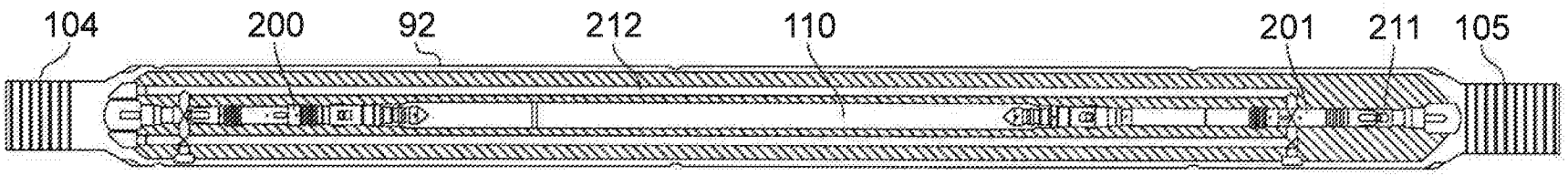
FIG. 4 shows details of the valve system shown in FIG. 2.
Figure 5:
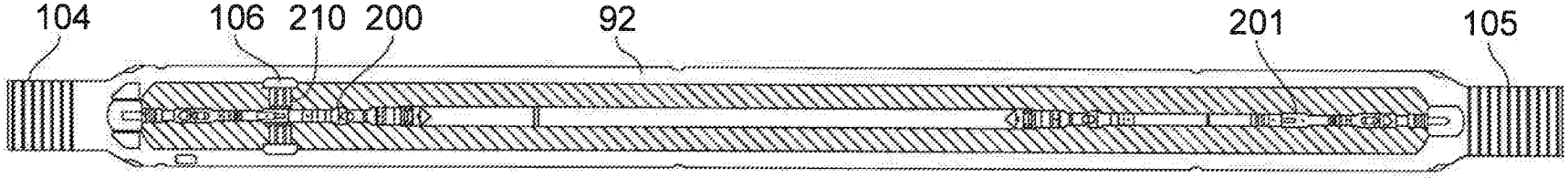
FIG. 5 shows details of the valve system shown in FIG. 2.

Referring now to FIGS. 4 and 5, which show top, cut views of the side pocket mandrel 92 shown in FIG. 3. The cut in FIG. 4 is approximately at the height of the central axes 114 and 115 (FIG. 3), while the cut in FIG. 5 is approximately at the height of the opening 106 (FIG. 2). The side pocket mandrel 92 comprises a first fluid passage 210 extending from an outside of the side pocket mandrel 92, via the opening 106, to an inside of the first receptacle 108. A second fluid passage 211 extends from the main bore 102 to the second receptacle 109. A third fluid passage 212 extends from the first receptacle 108 to the second receptacle 109, separate from the laterally offset side pocket bore 103. The first, second and third fluid passages 210,211,212 may be formed by channels machined in the body of the side pocket mandrel 92.

Figure 6:
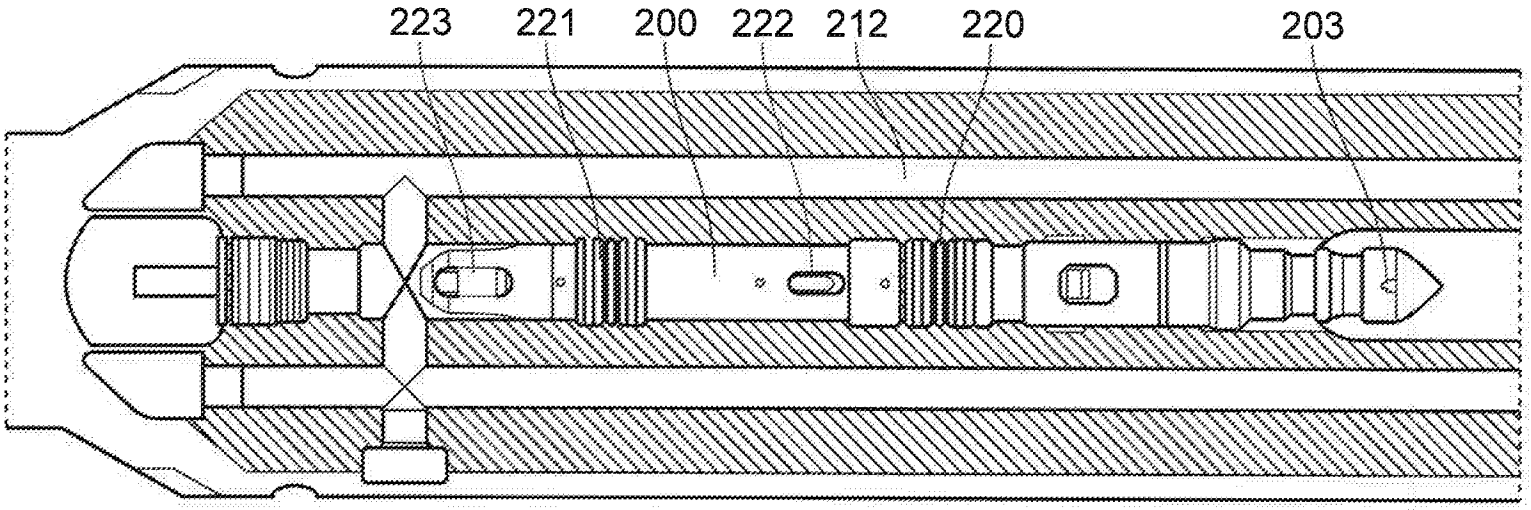
FIG. 6 shows details of the valve system shown in FIG. 2.

FIG. 6 illustrates the first gas lift valve 200 and the left hand side of the side pocket mandrel 92, as shown in FIG. 4, in more detail. The first gas lift valve 200 has an inlet 222 which is fluidly connected to the first fluid passage 210 when the first gas lift valve 200 is installed in the first receptacle 108. (See also FIG. 5.) The first gas lift valve 200 has an outlet 223 which, when the first gas lift valve 200 is installed in the first receptacle 108, is fluidly connected to the third fluid passage 212. Similarly, as can be seen in FIG. 4, the second gas lift valve 201 has an inlet which is fluidly connected to the third fluid passage 212, and an outlet which is fluidly connected to the second fluid passage 211, and thereby the main bore 102. A seal element 220 seals between the first gas lift valve 200 and the inner surface of the first receptacle 108 so as to prevent fluid communication between the first fluid passage 210 and the main bore 102 via the laterally offset side pocket bore 103. A seal element 221 is provided to seal between the first gas lift valve 200 and the inner surface of the first receptacle 108 so as to prevent fluid communication between the inlet 222 and the outlet 223 on an outside of the valve 200. The second gas lift valve 201 is provided with seals in an equivalent manner.

The first and second gas lift valves 200,201 are thus arranged in series to form a double fluid barrier between the opening 106 and the main bore 102. The valves 200,201 may, for example, be pressure controlled, i.e. to open in response to a fluid pressure, such that by pressurizing the outside of the side pocket mandrel 92, the first and second valves 200,201 can be brought to an open position and fluid communication between the opening 106 and the main bore 102 is established. This may be used for gas lift purposes in a well (see FIG. 1), whereby pressurizing the annulus 96 leads to the valves 200,201 opening and gaseous fluid flowing into the production tubing 90 via the side pocket mandrel 92.

In an embodiment, the present disclosure relates to a side pocket mandrel 92, also illustrated in FIGS. 2-6. The side pocket mandrel 92 comprises a longitudinally extending production conduit 102 having a central longitudinal axis 113; a first pocket 108 for accepting a barrier valve 200 and a second pocket 109 for accepting a barrier valve 201. The first and second pockets 108,109 have respective central axes 114,115. The first pocket 108 and the second pocket 109 are spaced in a direction parallel to the central longitudinal axis 113.

A first passage 106,210 fluidly connects an outside of the side pocket mandrel 92 to an inside of the first pocket 108. A second passage 212 fluidly connects the inside of the first pocket 108 to an inside of the second pocket 109. A third passage 211 fluidly connects the inside of the second pocket 109 to the production conduit 102. A fourth passage 110,111 connects the first and second pockets 108,109 to the production conduit 104 and allows insertion of a barrier valve 200,201 into the first and/or second pocket 108,109 via the fourth passage (110).

The first central axis 114 and the second central axis 115 may be parallel or co-axial.

In this embodiment, a first barrier valve 200 is arranged in the first pocket 108 and a second barrier valve 201 is arranged in the second pocket 109. In this embodiment, the first and second barrier valves 200,201 are gas lift barrier valves or chemical injection valves. The first barrier valve 200 and the second barrier valve 201 are arranged in series to form a double fluid barrier between the main bore 102 and the outside of the side pocket mandrel 92.

Each of the first and second barrier valves 200,201 may comprise a tool engagement element 203 configured for cooperating with an installation or retrieval tool for retrieving the respective first or second barrier valve 200,201 through the fourth passage 110,111.

In this embodiment, the first passage 106,210 extends substantially perpendicular to the first central axis 114 and the third passage 211 extends substantially perpendicular to the second central axis 115, while the second passage 212 extends substantially parallel to the first and second central axes 114,115.

In this embodiment, the fourth passage 110,111 comprises an opening 110 in an internal wall 107 separating the main bore 102 and the laterally offset side pocket bore 103. The opening 110 is, in the direction of the central longitudinal axis 113, located between the first pocket 108 and the second pocket 109.

In another embodiment, there is provided a hydrocarbon well having a production tubing 90 extending from a wellhead 93 into a subterranean formation (see FIG. 1), wherein the production tubing 90 comprises a valve system 101 and/or a side pocket mandrel 92 according to any of the embodiments described above.

In an embodiment, there is provided a method of operating a hydrocarbon well having a production tubing 90 extending from a wellhead 93 into a subterranean formation and comprising a valve system 101 and/or a side pocket mandrel 92 according to any of the embodiments described above, where the method comprises flowing gaseous a fluid into a well annulus 96, through the valve system 101 and/or the side pocket mandrel 92, and up the production tubing 90.

A gas compressor, or a different supply of gaseous fluid, may be located at surface and connected with the annulus 96 to provide pressurized gas into the annulus 96. If pressure-controlled gas lift barrier valves are used, then pressurizing the annulus 96 to a certain threshold pressure will activate the valves 200,201, and gas will flow into the production tubing 90.

According to an embodiment, the method may also comprise the step of installing a valve 200,201 in the side pocket mandrel 92; retrieving a valve 200,201 from the side pocket mandrel 92; installing a plug in the side pocket mandrel 92; retrieving a plug from the side pocket mandrel 92.

According to embodiments described herein, it is provided systems and methods downhole operations in petroleum wells. Downhole devices, such as gas lift valves, chemical injection valves, plugs, sensors, or other equipment, may be deployed or retrieved, for example for replacement or repair, in a safe and reliable manner. For example, in an artificial lift operation, a gas lift barrier valve 200,201 may be retrieved and replaced without fluid communication being open between the annulus 96 and the inside of the production tubing 90, since the second valve will maintain a fluid-tight barrier. This may, for example, allow replacement of devices and/or downhole equipment without shutting down the well.

Other devices may be used; for example, at the time of well completion, dummy plugs may be installed in the side pocket mandrel(s) 92. These dummy plugs may then, at a later time, be replaced with, for example, gas lift barrier valves 200,201, if artificial lift is required. This provides the advantage that a well completion can be installed with dummy plugs, which can efficiently and reliably be replaced with operative valves at a later time, since the time span between completion and a need for artificial lift, chemical injection, or other types of intervention, may be considerable.

According to embodiments described herein, a compact valve system 101 and/or side pocket mandrel 92 is provided. For example, by providing a central opening between the main bore 102 and the laterally offset side pocket bore 103, through which access to both receptacles/pockets 108 and 109 is provided, the overall length of the side pocket mandrel 92 can be reduced, and the operational reliability increased due to a reduced risk that debris and impurities accumulate near and/or around the devices mounted in the receptacles/pockets 108 and 109, which may disturb an installation, retrieval or replacement operation.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the embodiments of the disclosure in diverse forms thereof.

The present disclosure is not limited to the embodiments described herein; reference should be had to the appended claims.

The invention claimed is:

1. A valve system for use in a wellbore, the valve system comprising a side pocket mandrel having:

a main bore for alignment with a tubular in the wellbore, a laterally offset side pocket bore, the main bore and the laterally offset side pocket bore being separated by an internal wall, the laterally offset side pocket bore comprising:

a first receptacle for a first device, and a second receptacle for a second device, wherein:

the first receptacle and the second receptacle are arranged longitudinally spaced in opposite end sections of the laterally offset side pocket bore, the internal wall has an opening arranged between the end sections, through which each of the first device and the second device is independently retrievable; and the side pocket mandrel comprises a fluid passage extending from the first receptacle to the second receptacle, separate from the laterally offset side pocket bore, the fluid passage being configured to fluidly connect an outlet of the first device and an inlet of the second device.

2. A valve system according to claim 1, wherein the side pocket mandrel comprises:

an inlet opening; and a first fluid passage extending from an outside of the side pocket mandrel, via the inlet opening, to an inside of the first receptacle, the first fluid passage being configured to fluidly connect to an inlet of the first device.

3. A valve system according to claim 2, wherein the side pocket mandrel comprises a second fluid passage extending from the main bore to the second receptacle, the second fluid passage being configured to fluidly connect to an outlet of the second device.

4. A valve system according claim 3, wherein the fluid passage is a third fluid passage.

5. A valve system according to claim 4, wherein the first fluid passage, the second fluid passage and the third fluid passage are formed by channels machined in a body of the side pocket mandrel.

6. A valve system according to claim 1, wherein the first receptacle and the second receptacle are arranged co-axially.

7. A valve system according to claim 1, comprising the first device and the second device.

8. A valve system according to claim 7, wherein each of the first device and the second device is chosen from a group consisting of: flow control valves, gas lift valves, chemical injection valves, one-way valves, sensors, and dummy plugs.

9. A valve system according to claim 7, wherein the first device and the second device are arranged in series and configured to form a double fluid barrier between the main bore and an outside of the side pocket mandrel.

10. A valve system according to claim 7, wherein each device comprises a tool engagement element, the tool engagement element configured for cooperating with an installation or retrieval tool for retrieving the device through the opening.

11. A hydrocarbon well having a production tubing extending from a wellhead into a subterranean formation, wherein the production tubing comprises a valve system according to claim 1.

12. A method of operating a hydrocarbon well having a production tubing extending from a wellhead into a subterranean formation and comprising a valve system according to claim 1, the method comprising flowing a gaseous fluid into a well annulus, through the valve system, and up the production tubing.

13. A method according to claim 12, comprising at least one of the steps selected from the group consisting of:

installing a valve in the side pocket mandrel;

retrieving a valve from the side pocket mandrel;

installing a plug in the side pocket mandrel; and retrieving a plug from the side pocket mandrel.

14. A side pocket mandrel comprising:

a longitudinally extending production conduit having a central longitudinal axis;

a first pocket for accepting a first barrier valve, the first pocket having a first central axis;

a second pocket for accepting a second barrier valve, the second pocket having a second central axis;

a first passage fluidly connecting an outside of the side pocket mandrel to an inside of the first pocket;

a second passage fluidly connecting the inside of the first pocket to an inside of the second pocket;

a third passage fluidly connecting the inside of the second pocket to the production conduit; and a fourth passage connecting the first pocket and the second pocket to the production conduit, the fourth passage allowing:

insertion of one of the first barrier valve and the second barrier valve into each of the first pocket and the second pocket via the fourth passage; and independent retrieval of the first barrier valve and the second barrier valve; wherein the second passage is:

free from direct connection with the fourth passage; and configured to fluidly connect an outlet of the first barrier valve and an inlet of the second barrier valve.

15. A side pocket mandrel according to claim 14, wherein the first central axis and the second central axis are one of:

(i) parallel, or (ii) co-axial.

16. A side pocket mandrel according to claim 14, comprising:

the first barrier valve, arranged in the first pocket;

and the second barrier valve, arranged in the second pocket, wherein each of the first barrier valve and the second barrier valve is one of a gas lift barrier valve and a chemical injection valve.

17. A side pocket mandrel according to claim 14, wherein the first barrier valve and the second barrier valve are arranged in series to form a double fluid barrier between the main bore and the outside of the side pocket mandrel.

18. A side pocket mandrel according to claim 14, wherein each of the first barrier valve and second barrier valve comprises a tool engagement element, the tool engagement element configured for cooperating with an installation or retrieval tool for retrieving the respective at least one of the first and second barrier valve through the fourth passage.

19. A side pocket mandrel according claim 14, wherein the first passage extends substantially perpendicular to the first central axis.

20. A side pocket mandrel according to claim 14, wherein the third passage extends substantially perpendicular to the second central axis.

21. A side pocket mandrel according to claim 14, wherein the second passage extends substantially parallel to the first and second central axes.

22. A side pocket mandrel according to claim 14, wherein the first pocket and the second pocket are spaced in a direction parallel to the central longitudinal axis.

23. A side pocket mandrel according to claim 14, wherein the fourth passage comprises an opening in an internal wall separating the main bore and the laterally offset side pocket bore.

24. A side pocket mandrel according to claim 23, wherein the opening, in the direction of the central longitudinal axis, is located between the first pocket and the second pocket.

25. A hydrocarbon well having a production tubing extending from a wellhead into a subterranean formation, wherein the production tubing comprises a side pocket mandrel according to claim 14.

26. A method of operating a hydrocarbon well having a production tubing extending from a wellhead into a subterranean formation and comprising a side pocket mandrel according to claim 14, the method comprising flowing a gaseous fluid into a well annulus, through the side pocket mandrel, and up the production tubing.

27. A method according to claim 26, comprising at least one of the steps selected from the group consisting of:

installing a valve in the side pocket mandrel;

retrieving a valve from the side pocket mandrel;

installing a plug in the side pocket mandrel; and retrieving a plug from the side pocket mandrel.

28. A side pocket mandrel according to claim 14, wherein:

the first passage is configured to fluidly connect to an inlet of the first barrier valve; and the third passage is configured to fluidly connect to an outlet of the second barrier valve.

29. A side pocket mandrel according to claim 14, wherein the first passage, the second passage and the third passage are formed by channels machined in a body of the side pocket mandrel.

* * * * *